United States Patent [19]

Exner

[11] Patent Number: 4,891,276

[45] Date of Patent: Jan. 2, 1990

[54] ARTICLE OF JEWELRY OF PLATINUM AND FINE GOLD

[76] Inventor: Ursula Exner, Butenwall 113, 4426 Vreden, Fed. Rep. of Germany

[21] Appl. No.: 664,925

[22] Filed: Oct. 24, 1984

Related U.S. Application Data

[63] Continuation of Ser. No. 482,625, Apr. 6, 1983, abandoned.

[30] Foreign Application Priority Data

Apr. 10, 1982 [DE] Fed. Rep. of Germany ..... 3213543

[51] Int. Cl.[4] ..... B32B 15/01

[52] U.S. Cl. ..... 428/670; 63/2; 428/672; 428/927

[58] Field of Search ..... 428/669, 670, 672, 927; 63/2; D11/40, 76, 96; 29/160.6

[56] References Cited

U.S. PATENT DOCUMENTS

| | | | |
|---|---|---|---|
| 145,274 | 12/1873 | Blake | 428/670 |
| 192,167 | 6/1877 | Huguenin | 428/669 |
| 281,928 | 7/1883 | Rothschild | 428/927 |
| 450,412 | 4/1891 | Knight | 428/669 |
| 503,983 | 8/1893 | Palmer | 428/669 |
| 1,704,126 | 3/1929 | Fry | 428/670 |
| 1,996,183 | 4/1935 | Walters | 428/927 |
| 2,458,645 | 1/1949 | Rosenberg et al. | 428/669 |
| 3,667,098 | 6/1972 | Levy | 428/927 |
| 3,955,934 | 5/1976 | Tizzi | 428/672 |
| 4,107,947 | 8/1978 | Saito et al. | 63/2 |

FOREIGN PATENT DOCUMENTS 2733602 2/1979 Fed. Rep. of Germany .

*Primary Examiner*—Robert McDowell
*Attorney, Agent, or Firm*—Toren, McGeady & Associates

[57] ABSTRACT

An article of jewelry of platinum and fine gold of the type wherein the two metals are connected to one another by applying the fine gold in the solid state on the platinum and heating the fine gold to its melting temperature. The article of jewelry includes area portions of thin sheets of fine gold and reinforcements of platinum bordering the area portions of fine gold.

5 Claims, 2 Drawing Sheets

FIG.1
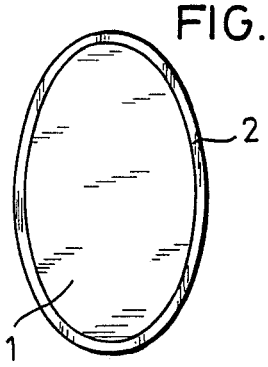
FIG.2
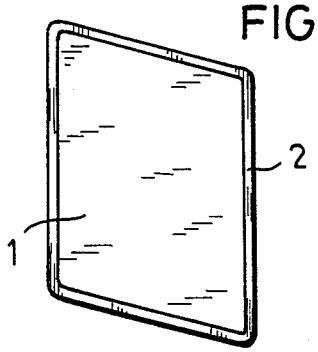
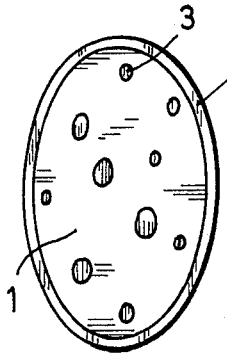
FIG.3
FIG.4
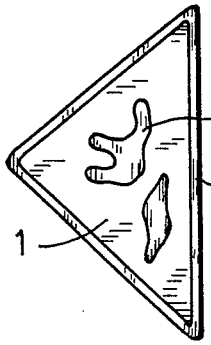
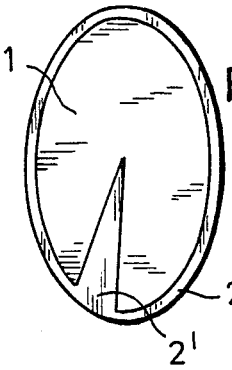
FIG.5
FIG.6
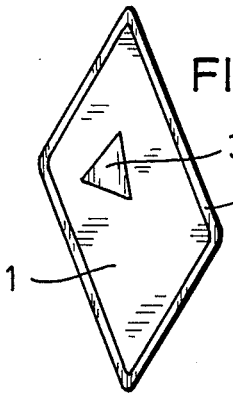

ARTICLE OF JEWELRY OF PLATINUM AND FINE GOLD

This is a continuation of application Ser. No. 482,625, filed Apr. 6, 1983, now abandoned.

BACKGROUND OF THE INVENTION

The present invention relates to an article of jewelry of platinum and fine gold, and more particularly to an article of jewelry of the type wherein the two metals are connected to one another by applying the fine gold in the solid state on the platinum and heating the fine gold to its melting temperature.

An article of jewelry of this type is known from German Patent No. 27 33 602 which is owned by the applicant. In this known article of jewelry, platinum is the carrier metal and and a coating of fine gold placed on the carrier is used. The platinum portion in this known article of jewelry is at least equal to or greater than the fine gold portion because the fine gold coating has an essentially decorative character and is not intended to form the principal component of the article of jewelry.

Furthermore, German Patent No. 561 705 describes a method for welding thin platinum sheets by means of a doubling process onto a sheet of gold of sufficient thickness. Jewelry plates manufactured in this manner are used in boxes clock housings and the like. In other words, the method described in this German patent is not used to strengthen the sheet of gold. Rather, the method starts with a sheet of gold of sufficient thickness.

Other pieces of jewelry are disclosed in U.S. Pat. Nos. 3,955,934 and 4,107,947. Areas of these pieces of jewelry consist of thin sheet metal. They are primarily intended for producing an ornamental effect.

The processing of sheets of fine gold meets with certain natural limits because even in the solid state fine gold does not always have the desired strength necessary for articles of jewelry. Moreover, when the sheets of fine gold become thinner and thinner, there exists the danger that the edges of the sheets fray, tear, are accidentally deformed and the like.

It is, therefore, an object of the invention to provide a solution which makes it possible to exceed the natural processing limits of sheets of fine gold referred to above.

SUMMARY OF THE INVENTION

In accordance with the present invention, an article of jewelry of the type described above includes area portions of thin sheets of fine gold and reinforcements of platinum bordering the area portions of fine gold.

The gold used in the article of jewelry according to the present invention is high-carat gold wherein the gold portion in the alloy ranges from 75% to 100%.

It has surprisingly been found that a fine reinforcement of platinum bordering the edge of a thin sheet or leaf of fine gold imparts a very high strength to the latter and facilitates a further processing thereof. In the case of sheets of fine gold having a relatively large size area, it may be useful to provide, in addition to a reinforcement bordering the edge of the sheet of fine gold, an internal reinforcement of platinum. Internal reinforcement means either the arrangement of platinum portions interspersed in the area portion of the sheet of fine gold, or the arrangement of a layer of platinum adjacent a layer of fine gold or between two sheets of fine gold, so that this reinforcement is not visible or only partially visible from the outside.

In accordance with a further development of the invention, the thickness of the sheet of fine gold is less than 0.5 mm.

The article of jewelry according to the present invention may be formed of an inner area of fine gold surrounded by a border of platinum. Also, platinum elements may be arranged within the platinum border interspersed in the inner area of fine gold. In addition, the platinum elements may be constructed in the form of a framework connected to the platinum border.

The platinum border, the platinum elements within the fine gold and the platinum framework elements may have geometrically simple shapes, or they may be arranged within the area or areas of fine gold in any chosen configuration and shape.

A special ornamental effect may be obtained by arranging the platinum elements only on one side of the sheet of fine gold surrounded by the platinum border.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

BRIEF DESCRIPTION OF THE DRAWING

In the drawing:

FIGS. 1, 2, 5, 9 and 10 are schematic plan views of articles of jewelry in accordance with the present invention, with reinforcements of platinum of various designs surrounding an area portion of a sheet of fine gold;

FIGS. 3, 4, 6, 7 and 8 are schematic plan views of articles of jewelry having border reinforcements as well as internal reinforcements.

DETAILED DESCRIPTION OF THE INVENTION

Figure 7:
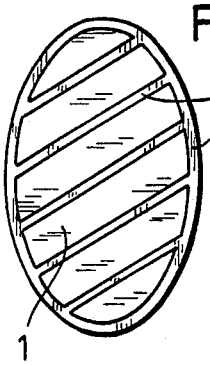

As illustrated in the drawing, a sheet or leaf of fine gold denoted by reference numeral 1 is provided with a border reinforcement 2 of platinum. The connection between platinum and fine gold is produced in accordance with the method disclosed in German Patent No. 27 33 602. In other words, the leaf of fine gold is placed, for example, on a platinum wire and is heated in this region to its melting temperature and is thereby connected to the platinum. The resulting article can then be further processed. For example, the leaf of fine gold having the border reinforcement can be made thinner, the invention making it possible to reach a wall thickness of the article which is thinner than the wall thicknesses reached in the past because in the article according to the present invention there does not exist the danger that the edges fray, tear or the like.

In addition to the border reinforcements 2, inner reinforcements 3 may also be provided. The inner reinforcements may have geometrically simple shapes, such as those illustrated in FIGS. 3 and 6, or they may be of any chosen shape with irregular contours, as is indicated in FIG. 4.

FIG. 5 shows a special embodiment of the invention wherein a triangular portion 2' which forms one piece with the border reinforcement 2 extends into the area portion 1 of the fine gold sheet.

Figure 8:
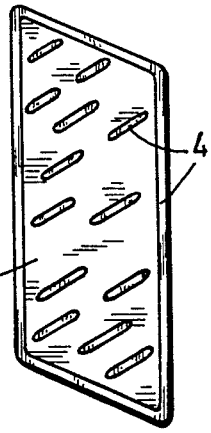

FIGS. 7 and 8 illustrate possibilities for equipping the area portion of the sheet of fine gold with a framework 4 of platinum rods or the like. These platinum rods may be connected to the border reinforcement of platinum, as shown in FIG. 7, or they may be unconnected, as shown in FIG. 8.

Figure 9:
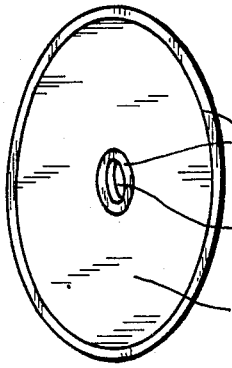
Figure 10:
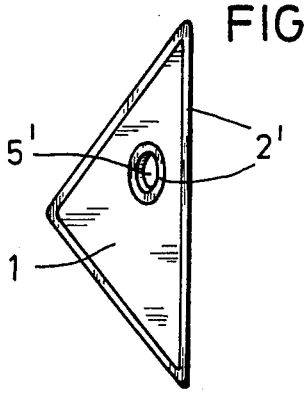

FIGS. 9 and 10 show articles of jewelry wherein the respective area portion of the sheet of fine gold has a breakthrough 5 and the border reinforcements 2' are provided at the outer edge of the area portion as well as at the edge of the breakthrough.

Figure 11:
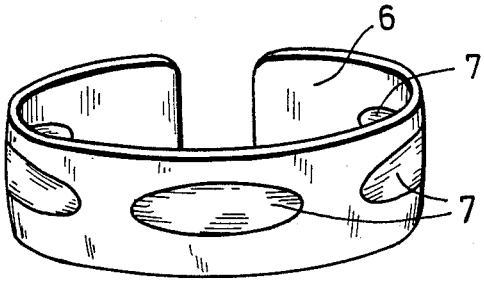
FIG. 11 is a perspective view of a bracelet with fine gold membranes fixed in platinum.

Finally, FIG. 11 illustrates an article of jewelry in which the membranes 7 of fine gold are fixed in a platinum body 6.

While specific embodiments of the invention have been shown and described in detail to illustrate the application of the inventive principles, it will be understood that the invention may be embodied otherwise without departing from such principles. The invention is particularly not limited to the specific shapes or designs of the articles of jewelry and the reinforcement inserts or borders illustrated in the drawing. The sheets of fine gold having a thin wall thickness manufactured in accordance with the present invention with platinum reinforcements can be further processed into ornaments, fixtures or objects of various designs.

Another important aspect of the invention is that the border reinforcements 2 and the inner reinforcements 3 may be combined with a thin sheet of platinum, so that a thin bimetal sheet is formed consisting of a layer of platinum and a layer of fine gold. This thin bimetal sheet has excellent properties with respect to further processing and strength.

I claim:

1. An article of jewelry of platinum and fine gold, the platinum and fine gold connected by applying the fine gold in the solid state on the platinum and heating the fine gold to its melting temperature, wherein the improvement comprises the the article of jewelry comprises and area portion of a single thin sheet of fine gold having a circumferential outer edge, at least one platinum reinforcement bordering said outer edge so as to surround and reinforce said area portions of said sheet of fine gold, and an internal platinum reinforcement arranged spaced from said outer edge within said sheet of fine gold.

2. An article of jewelry in accordance with claim 1, wherein said fine gold is a high-carat gold alloy with a gold portion ranging between 75% and 100%.

3. An article of jewelry in accordance with claim 1, wherein said internal reinforcement is formed by a plurality of platinum elements arranged in said area of fine gold within said border of platinum.

4. An article of jewelry in accordance with claim 3, wherein said area of fine gold surrounded by said border of platinum has a top and a bottom surface and said platinum elements are arranged only on one of said top and bottom surfaces.

5. An article of jewelry of platinum and fine gold, the platinum and fine gold connected by applying the fine gold in the solid state on the platinum and heating the fine gold to its melting temperature, wherein the improvement comprises that the article of jewelry comprises an area portion of a single thin sheet of fine gold having a circumferential outer edge, at least one platinum reinforcement bordering said outer edge so as to surround and reinforce said area portions of said sheet of fine gold, wherein said fine gold has a thickness of less than 0.5 mm.

* * * * *